US009675149B1

(12) United States Patent
Saffold

(10) Patent No.: US 9,675,149 B1
(45) Date of Patent: Jun. 13, 2017

(54) EYEWEAR STORAGE SYSTEM

(71) Applicant: Johnnie L. Saffold, Vero Beach, FL (US)

(72) Inventor: Johnnie L. Saffold, Vero Beach, FL (US)

( * ) Notice: Subject to any disclaimer, the term of this patent is extended or adjusted under 35 U.S.C. 154(b) by 162 days.

(21) Appl. No.: 14/997,629

(22) Filed: Jan. 18, 2016

(51) Int. Cl.
*A45C 11/04* (2006.01)
*G02C 3/04* (2006.01)

(52) U.S. Cl.
CPC ..... *A45C 11/04* (2013.01); *G02C 3/04* (2013.01)

(58) Field of Classification Search
CPC ..... A45C 11/04; G02C 3/04; A47F 7/021
USPC ..... 206/5; 211/85.1
See application file for complete search history.

(56) References Cited

U.S. PATENT DOCUMENTS 2,359,372 A * 10/1944 Leader ..... A45C 3/12 211/35
2,816,666 A * 12/1957 Nadel ..... A47F 5/02 206/461
3,134,416 A * 5/1964 Magyar ..... A45C 7/0095 206/1.7
3,955,681 A * 5/1976 DeZinno ..... A47B 87/0223 206/511
4,239,167 A 12/1980 Lane
4,452,354 A 6/1984 Tabachnick
4,585,127 A * 4/1986 Benedict ..... A47B 61/02 211/34
5,137,242 A 8/1992 Reath
5,427,239 A * 6/1995 Hunt ..... B25H 3/00 190/125
5,431,265 A * 7/1995 Yoo ..... A45C 3/00 190/103
D378,023 S 2/1997 Grassey
5,598,923 A * 2/1997 Owens ..... A61B 50/312 150/130
6,039,173 A 3/2000 Crow
6,135,407 A 10/2000 Havis et al.
6,193,034 B1 * 2/2001 Fournier ..... A45C 7/0095 190/107
6,880,710 B1 * 4/2005 Oliveras ..... A47F 7/021 206/5
D546,559 S 7/2007 Boyette
7,789,366 B2 9/2010 McDonald
2007/0151870 A1 * 7/2007 Boyette ..... A45C 11/04 206/5
2007/0215493 A1 * 9/2007 Servis ..... A45C 11/04 206/5

* cited by examiner

*Primary Examiner* — Steven A. Reynolds

(57) ABSTRACT

An eyewear storage system includes a plurality of articles of eyewear. A storage unit is provided. The storage unit may be coupled to a vertical storage surface. Each of the articles of eyewear is removably positionable in the storage unit. Thus, the articles of eyewear are accessible. The storage unit includes a non-abrasive material such that the storage unit is inhibited from abrading the articles of eyewear.

5 Claims, 4 Drawing Sheets

EYEWEAR STORAGE SYSTEM

BACKGROUND OF THE DISCLOSURE

Field of the Disclosure

The disclosure relates to storage devices and more particularly pertains to a new storage device for storing and organizing articles of eyewear.

SUMMARY OF THE DISCLOSURE

An embodiment of the disclosure meets the needs presented above by generally comprising a plurality of articles of eyewear. A storage unit is provided. The storage unit may be coupled to a vertical storage surface. Each of the articles of eyewear is removably positionable in the storage unit. Thus, the articles of eyewear are accessible. The storage unit is comprised of a non-abrasive material such that the storage unit is inhibited from abrading the articles of eyewear.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
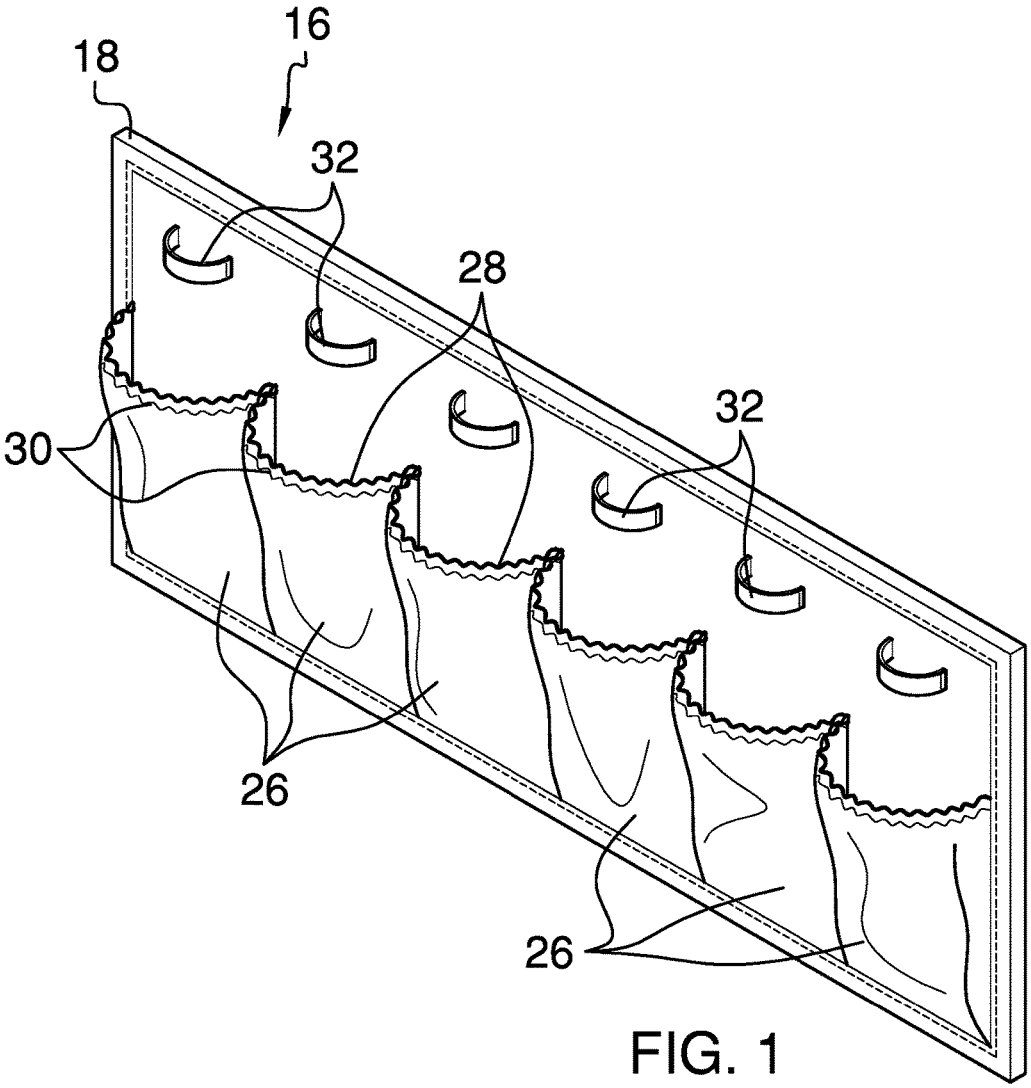
FIG. 1 is a front perspective view of an eyewear storage system according to an embodiment of the disclosure.
Figure 2:
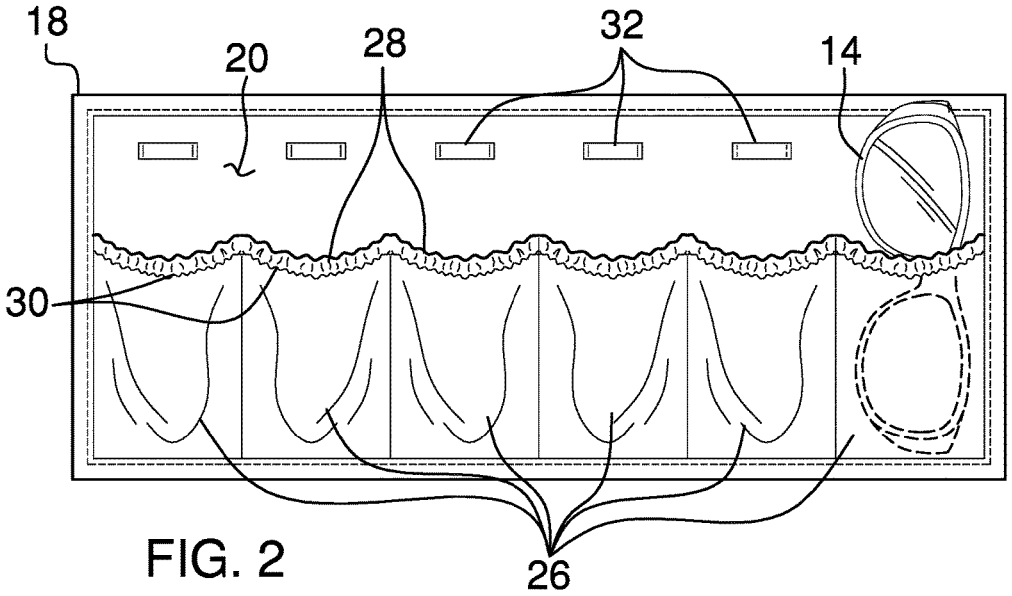
FIG. 2 is a front view of an embodiment of the disclosure.
Figure 3:
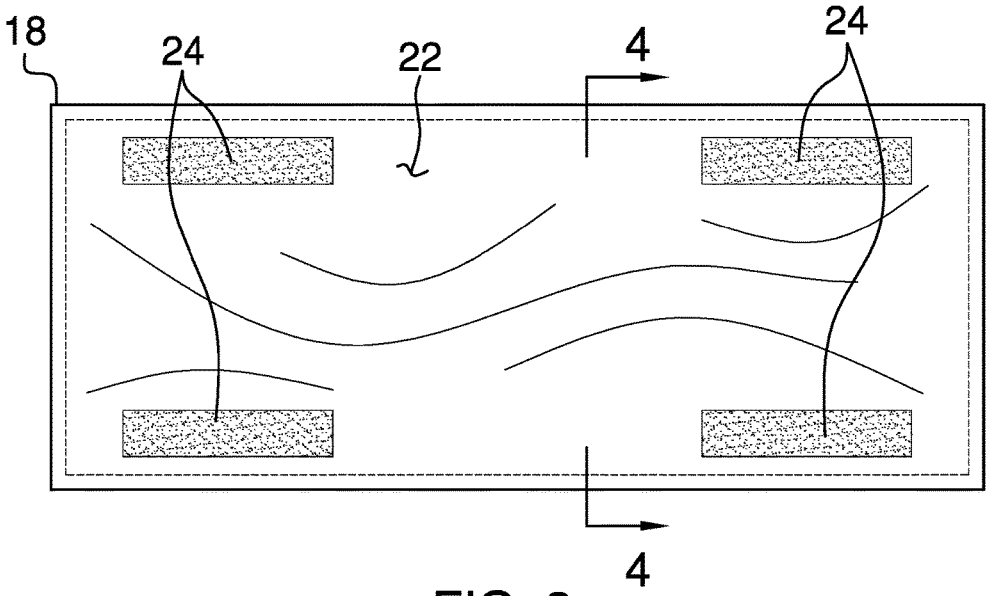
FIG. 3 is a back view of an embodiment of the disclosure.
Figure 4:
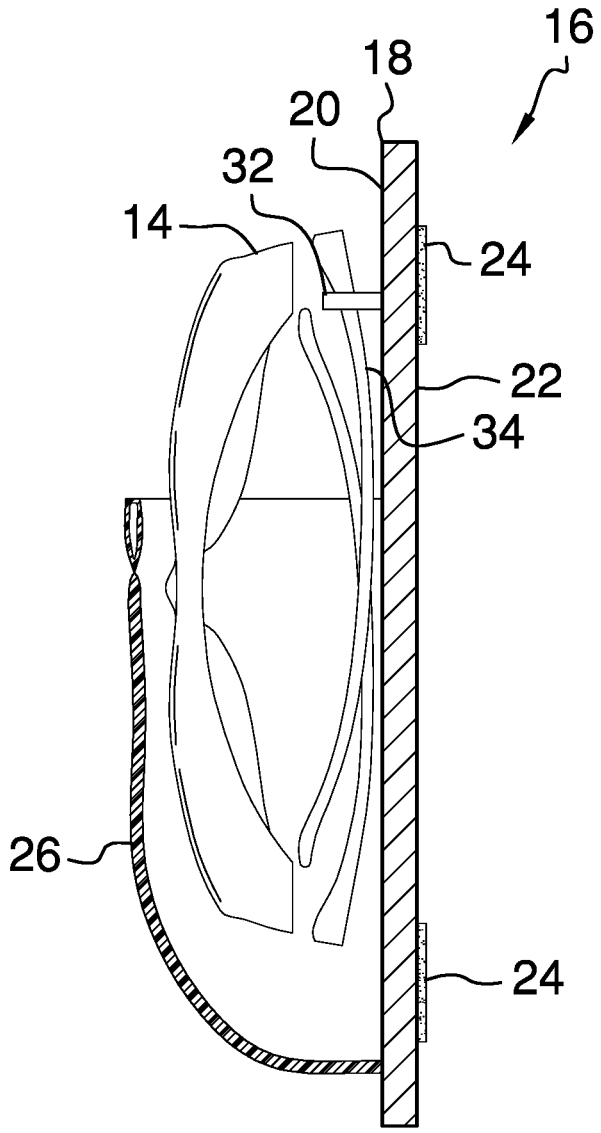
FIG. 4 is a cross sectional view taken along line 4-4 of FIG. 3 of an embodiment of the disclosure.
Figure 5:
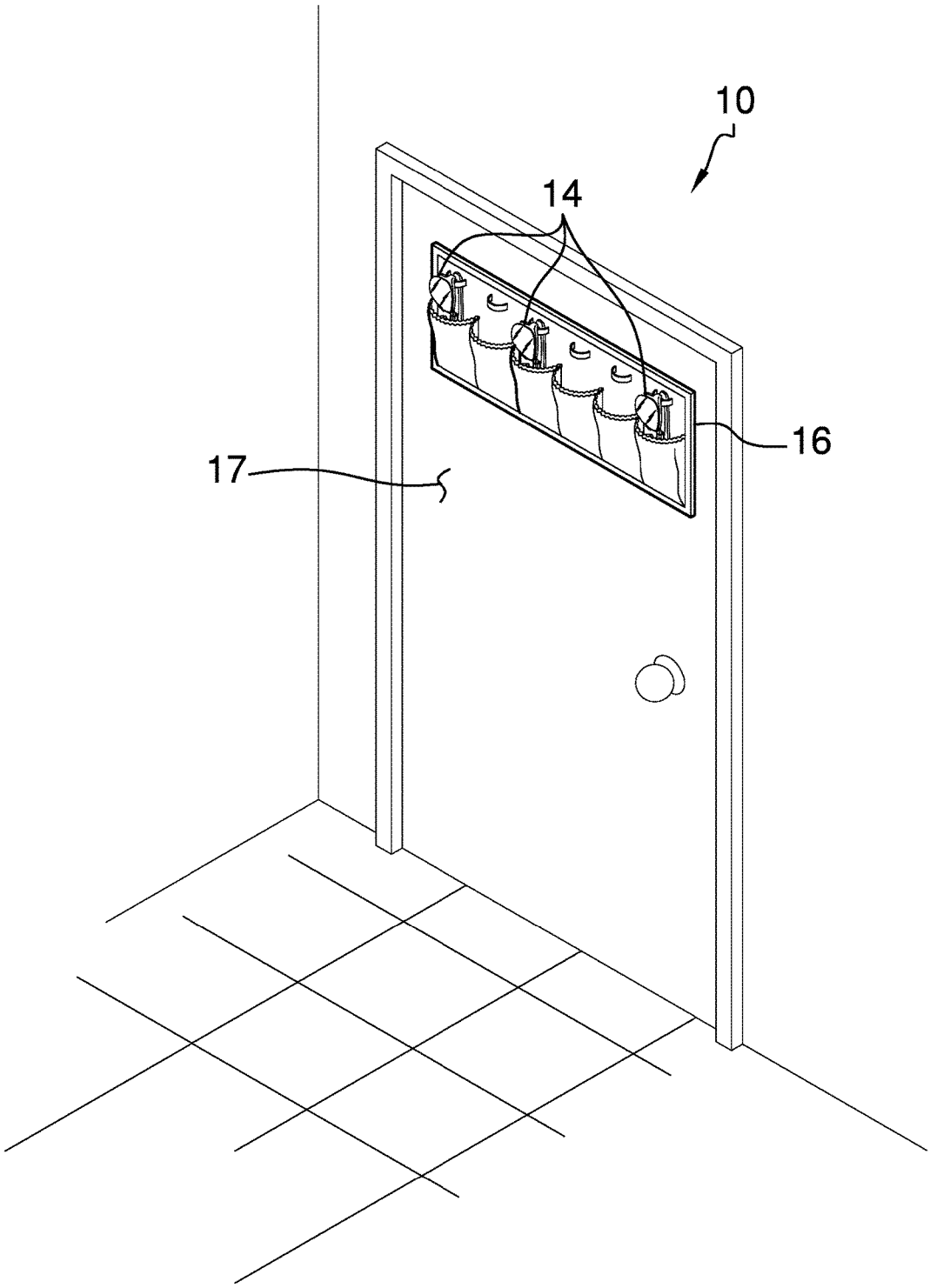
FIG. 5 is a perspective in-use view of an embodiment of the disclosure.

With reference now to the drawings, and in particular to FIGS. 1 through 5 thereof, a new storage device embodying the principles and concepts of an embodiment of the disclosure and generally designated by the reference numeral 10 will be described.

As best illustrated in FIGS. 1 through 5, the eyewear storage system 10 generally comprises a plurality of articles of eyewear 14. Each of the articles of eyewear 14 may comprise sunglasses or the like. A storage unit 16 is provided and the storage unit 16 may be coupled to a vertical support surface 17. The vertical support surface 17 may comprise a door or the like.

Each of the articles of eyewear 14 is removably positionable in the storage unit 16. Thus, the articles of eyewear 14 are accessible when the articles or eyewear 14 are not worn. The storage unit 16 is comprised of a non-abrasive material such that the storage unit 16 is inhibited from abrading the articles of eyewear 14. The non-abrasive material may comprise a textile or the like.

The storage unit 16 comprises a panel 18 that has a front surface 20 and a rear surface 22. The rear surface 22 is coupled to the vertical support surface 17. A plurality of couplers 24 is provided and each of the couplers 24 is coupled to the rear surface 22. Each of the couplers 24 may comprise double sided tape or the like. Thus, each of the couplers 24 may adhesively engage the vertical support surface 17 thereby retaining the panel 18 on the vertical support surface 17.

A plurality of pockets 26 is provided and each of the pockets 26 is coupled to the front surface 20 of the panel 18. The pockets 26 are spaced apart from each other and distributed longitudinally along the panel 18. Each of the pockets 26 has a top end 28 and the top end 28 is open. Each of the articles of eyewear 14 is insertable into the top end 28 of an associated one of the pockets 26. Each of the pockets 26 may be comprised of a cotton fiber textile or the like. Thus, the pockets 26 are inhibited from scratching the articles of eyewear 14. The panel 18 may be comprised of a canvas textile or the like thereby facilitating the panel 18 to support a weight of the pockets 26.

A plurality of elastic members 30 is provided and each of the elastic members 30 is coupled to an associated one of the pockets 26. Each of the elastic members 30 is coextensive with the top end 28 of the associated pocket 26. Each of the elastic members 30 biases the top end 28 of the associated pocket 26 to frictionally engage an associated one of the articles of eyewear 14. Thus, the associated article of eyewear 14 is retained in the associated pocket 26. Alternatively, any object, such as a smart phone or the like, may be positioned within the pockets 26.

A plurality of loops 32 is provided and each of the loops 32 is coupled to the front surface 20 of the panel 18. Each of the loops 32 forms a closed semi-circle with respect to the panel 18 and each of the loops 32 is positioned above the pockets 26. Each of the loops 32 is aligned with the top end 28 of an associated one of the pockets 26. An arm 34 corresponding to an associated one of the articles of eyewear 14 is extended through an associated one of the loops 32 when the associated article of eyewear 14 is positioned in the associated pocket 26. Thus, the associated article of eyewear 14 is inhibited from falling forwardly out of the associated pocket 26.

In use, the panel 18 is coupled to the vertical support surface 17 and the panel 18 is positioned at a desired height on the vertical support surface 17. The articles of eyewear 14 are stored in the pockets 26 when the articles of eyewear 14 are not worn. Thus, the articles of eyewear 14 are inhibited from being misplaced. The pockets 26 inhibit the articles of eyewear 14 from becoming scratched when the articles of eyewear 14 are not worn. Any object may be stored within the pockets 26 for organizational purposes.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An eyewear storage system comprising:

a plurality of articles of eyewear; and a storage unit being configured to be coupled to a vertical storage surface, each of said articles of eyewear being removably positionable in said storage unit wherein said articles of eyewear is configured to be accessible, said storage unit being comprised of a non-abrasive material such that said storage unit is inhibited from abrading said articles of eyewear, said storage unit comprising a panel having a front surface and a rear surface, said rear surface being configured to be coupled to the vertical support surface;

a plurality of pockets, each of said pockets being coupled to said front surface of said panel, said pockets being spaced apart from each other and distributed longitudinally along said panel, each of said pockets having a top end, said top end being open such that each of said articles of eyewear is insertable into said top end of an associated one of said pockets; and a plurality of loops, each of said loops being coupled to said front surface of said panel such that each of said loops forms a closed semi-circle with respect to said panel, each of said loops being positioned above said pockets, each of said loops being aligned with said top end of an associated one of said pockets.

2. The system according to claim 1, further comprising a plurality of couplers, each of said couplers being coupled to said rear surface, each of said couplers being configured to engage the vertical support surface thereby retaining said panel on the vertical support surface.

3. The system according to claim 1, further comprising a plurality of elastic members, each of said elastic members being coupled to an associated one of said pockets, each of said elastic members being coextensive with said top end of said associated pocket, each of said elastic members biasing said top end of said associated pocket to frictionally engage an associated one of said articles of eyewear thereby retaining said associated article of eyewear in said associated pocket.

4. The system according to claim 1, wherein an arm corresponding to an associated one of said articles of eyewear is extended through an associated one of said loops when said associated article of eyewear is positioned in said associated pocket such that said associated article of eyewear is inhibited from falling forwardly out of said associated pocket.

5. An eyewear storage system comprising:

a plurality of articles of eyewear; and a storage unit being configured to be coupled to a vertical storage surface, each of said articles of eyewear being removably positionable in said storage unit wherein said articles of eyewear is configured to be accessible, said storage unit being comprised of a non-abrasive material such that said storage unit is inhibited from abrading said articles of eyewear, said storage unit comprising:

a panel having a front surface and a rear surface, said rear surface being configured to be coupled to the vertical support surface, a plurality of couplers, each of said couplers being coupled to said rear surface, each of said couplers being configured to engage the vertical support surface thereby retaining said panel on the vertical support surface, a plurality of pockets, each of said pockets being coupled to said front surface of said panel, said pockets being spaced apart from each other and distributed longitudinally along said panel, each of said pockets having a top end, said top end being open such that each of said articles of eyewear is insertable into said top end of an associated one of said pockets, a plurality of elastic members, each of said elastic members being coupled to an associated one of said pockets, each of said elastic members being coextensive with said top end of said associated pocket, each of said elastic members biasing said top end of said associated pocket to frictionally engage an associated one of said articles of eyewear thereby retaining said associated article of eyewear in said associated pocket, and a plurality of loops, each of said loops being coupled to said front surface of said panel such that each of said loops forms a closed semi-circle with respect to said panel, each of said loops being positioned above said pockets, each of said loops being aligned with said top end of an associated one of said pockets, an arm corresponding to an associated one of said articles of eyewear being extended through an associated one of said loops when said associated article of eyewear is positioned in said associated pocket such that said associated article of eyewear is inhibited from falling forwardly out of said associated pocket.

* * * * *